United States Patent [19]

Schnürle et al.

[11] 4,254,742

[45] Mar. 10, 1981

[54] APPARATUS FOR ADAPTING ENGINE FUEL SUPPLY TO AMBIENT AIR TEMPERATURE

[75] Inventors: Hans Schnürle, Walheim; Ulrich Drews, Vaihingen-Pulverdingen; Peter Werner, Stuttgart; Lothar Winkelmann, Ludwigsburg, all of Fed. Rep. of Germany

[73] Assignee: Robert Bosch GmbH, Stuttgart, Fed. Rep. of Germany

[21] Appl. No.: 882,517

[22] Filed: Mar. 1, 1978

Related U.S. Application Data

[63] Continuation of Ser. No. 684,931, May 10, 1976, abandoned.

[30] Foreign Application Priority Data

May 10, 1975 [DE] Fed. Rep. of Germany ..... 2520911

[51] Int. Cl.[2] ..... F02B 3/00

[52] U.S. Cl. ..... 123/32 EA

[58] Field of Search ..... 123/32 EA

[56] References Cited

U.S. PATENT DOCUMENTS

| | | | |
|---|---|---|---|
| 3,203,410 | 8/1965 | Scholl | 123/32 EA |
| 3,796,198 | 3/1974 | Mauch et al. | 123/32 EA |
| 3,796,199 | 3/1974 | Knapp | 123/32 EA |
| 3,982,503 | 9/1976 | Keranen | 123/32 EA |
| 4,133,320 | 1/1979 | Bianchi et al. | 123/32 EA |

*Primary Examiner*—Charles J. Myhre
*Assistant Examiner*—R. A. Nelli
*Attorney, Agent, or Firm*—Edwin E. Greigg

[57] ABSTRACT

A fuel injection control system generates control pulses which open the fuel injection valves of the engine. The pulse duration is proportional to the injected fuel quantity and can be altered in dependence on air temperature by a circuit which includes a temperature-sensitive resistor. The voltage at this resistor controls a transistor which supplies a supplementary charging current for a timing capacitor.

5 Claims, 2 Drawing Figures

APPARATUS FOR ADAPTING ENGINE FUEL SUPPLY TO AMBIENT AIR TEMPERATURE

This is a continuation of application Ser. No. 684,931 filed May 10, 1976 abandoned.

BACKGROUND OF THE INVENTION

The invention relates to an apparatus for adapting the fuel quantity supplied by a fuel injection system to prevailing air temperatures. The fuel injection system supplies control information on the basis of engine rpm and air flow rate in the form of injection valve opening pulses whose duration determines the fuel quantity supplied to the engine.

It is a well known fact that the density of the air increases with decreasing temperature and this fact results in a greater air quantity admitted to the combustion chambers of the engine. Since, normally, the fuel-air ratio of the engine is attempted to be held constant, for example corresponding to the stoichiometric ratio or some other predetermined ratio, a correction is required if the fuel injection system cannot itself make the required adjustments for a changing air temperature.

In order to maintain a desired fuel-air ratio when the air temperature drops or, in the most general case, to make any arbitrary correction, a special correction is required which changes the fuel injection duration, and in the normal case, lengthens it.

OBJECT AND SUMMARY OF THE INVENTION

It is a principal object of the invention to provide an apparatus to be used in conjunction with a fuel injection system which permits adapting the duration of the fuel injection time to the temperature of the air supplied to the engine.

This object is attained, according to the invention, by providing a temperature-dependent element, preferably a temperature-dependent resistor, somewhere in the air induction channel of the engine and connecting this element in series with a resistor between points of differing electric potential. The junction of the resistor and the temperature-dependent element is coupled to one of the main electrodes of an active semiconductor element whose control electrode, in turn, is connected to the tap of an adjustable voltage divider circuit, while the second main electrode is used to supply a current which is normally constant but whose magnitude depends on the air temperature and which is added to the charging current of the timing capacitor in the main fuel supply system and thereby causes an increase in the fuel injection duration.

The apparatus according to the invention brings the advantage of gentle engagement in the control process for the fuel injection time. Furthermore, appropriate values and dimensions of the circuit can adjust that temperature beyond which a prolongation of the injection time is to take place. It should be mentioned that the circuit providing the air temperature correction always supplies a well-defined constant current whose magnitude depends only on the air temperature.

In a preferred exemplary embodiment, this well defined current is supplied to a so-called multiplier circuit of the fuel injection system in such a manner that the charging current for the timing capacitor in a monostable multivibrator can be changed.

The invention will be better understood and further objects and advantages thereof will become more apparent from the ensuing detailed specification of a preferred embodiment taken in conjunction with the drawing.

DESCRIPTION OF THE PREFERRED EMBODIMENT

Figure 1:
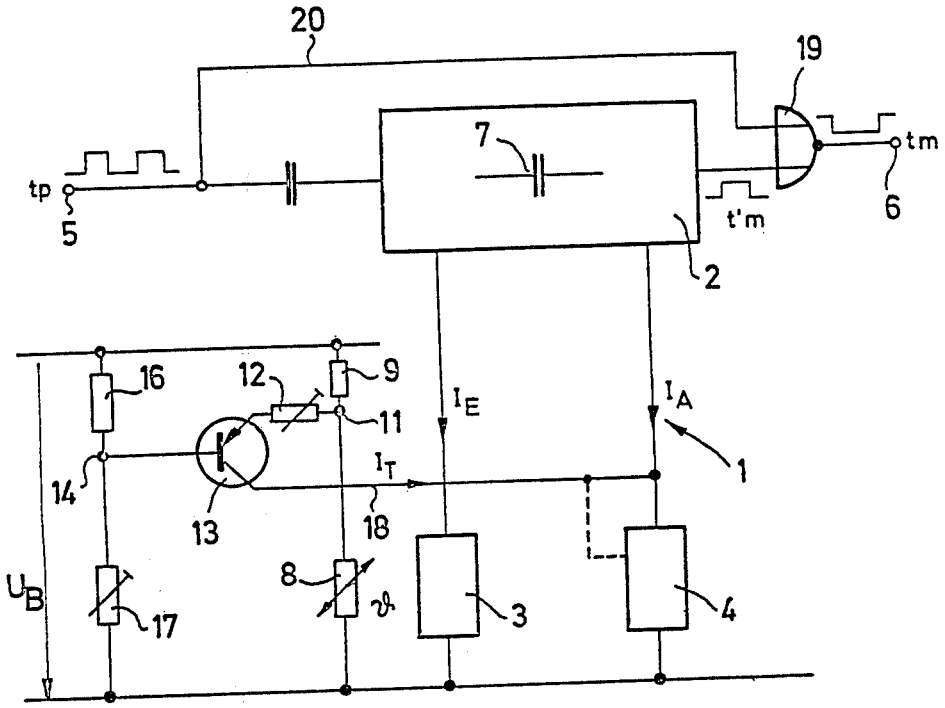
FIG. 1 is a schematic diagram of a portion of the complete fuel injection system including a detailed circuit diagram of the air temperature correction circuit.

Before treating the air temperature correction circuit in detail, it appears suitable to discuss the general principles of a fuel injection system in which the air temperature correction is preferably used.

A substantial component of a fuel injection system of this type is a so-called control multivibrator circuit which is so built as to provide an output control pulse $t_p$ whose duration depends on the aspirated air quantity and the instantaneous engine rpm and whose duration defines the duration of the final injection control pulses. This control multivibrator includes a monostable multivibrator with a timing capacitor in its feedback path and the time constant of this monostable multivibrator is in turn defined by the time required for the charge exchange in the capacitor and this time is determined by the action of a charging current source and a discharging current source. The discharging current is a measure of the air quantity supplied to the engine while the charging current is supplied to the timing capacitor in synchronism with the rpm and during a predetermined crankshaft angle. In this manner, one obtains output pulses $t_p$ which are supplied to the contact 5 shown in FIG. 1 and whose duration is a measure for the fuel quantity to be supplied during each suction stroke.

In view of the foregoing, it will be seen that the pulses $t_p$ contain information regarding the main control functions, namely the rpm and the air flow rate; however, for optimum adaptation to particular operational domains, certain corrections may be required in the duration of the pulse $t_p$ and these corrections may sometimes be considerable. For this purpose, a secondary circuit is connected behind the above-described control multivibrator circuit and this secondary circuit has the overall reference numeral 1 in FIG. 1. Its purpose is to so prolong the pulse duration $t_p$ that a more suitable value is obtained for final control of the injection valves and this final signal has the reference numeral $t_m$ and is supplied to the output 6 in FIG. 1. This additional circuit permits various types of corrections of the fuel injection duration among which, in particular, is a correction based on changing air temperature and it is this correction circuit which is one subject of the present invention and will now be explained in detail.

The additional circuitry operates, in principle, in a similar manner as the main control multivibrator and will be referred to as a multiplying circuit. This multiplying circuit 1 consists primarily of a monostable multivibrator 2 with associated constant current sources 3 and 4, the current source 4 being the charging source supplying the charging current $I_A$ while the constant current source 3 supplies the discharging current $I_E$. The timing capacitor, which is part of this multiplying circuit, is indicated schematically with the numeral 7.

The method of operation of this circuit 1 is that, during the duration of the pulse $t_p$ fed to the contact 5, a capacitor 7 is charged at a rate corresponding to the charging current $I_A$. Subsequently, the multivibrator is triggered and the capacitor discharges at the discharge current $I_E$. The duration of the discharge process is equal to the time constant $t_m'$ of the monostable multivibrator 2. In the normal case, the discharge current $I_E$ is chosen to be approximately equal to the charge $I_A$. Both of these currents may be adjusted in magnitude by certain corrections which correspond to particular operating conditions of the enging by adding or subtracting additional currents which increase or decrease the charging or discharging currents and thereby directly influence the time constant of the monostable multivibrator 2. The voltage drop at the timing capacitor 7 is small and hence it is suitable to apply only small corrections to the charging current $I_A$ and this is the case for the present air temperature correction.

The air temperature correction circuit includes a temperature-dependent element; in the present preferred exemplary embodiment this element is a temperature-dependent resistor 8, which may be an NTC resistor and is preferably located in the induction channel of the engine. The temperature-dependent resistor 8 is connected in series with a further resistor 9 and the two resistors are connected between the two poles of the supply voltage so that the junction 11 between the two resistors is at a potential which is determined by the air temperature in the induction channel. Connected to this junction 11 is one main electrode of an active semiconductor element, for example a transistor 13, through an adjustable resistor 12. In the exemplary embodiment, the emitter of the transistor 13 is the electrode connected to the resistor 12 and thus experiences the changing potential at the point 11. The control electrode, i.e., the base of the transistor 13, is connected to the junction 14 of a further voltage divider circuit consisting of the resistors 16 and 17 also connected between the main supply voltages. The second main electrode, i.e., the collector of the transistor 13, is connected through a line 18 to the multiplier circuit 1 so that an additional partial current $I_T$ is added to the normal charging current $I_A$. The additional $I_T$ is temperature-dependent and will lead to an increase of the time constant of the monostable multivibrator 2. The partial current $I_T$ may be introduced into the charging current source 4 in any desired manner, as indicated by the dashed line. When the ambient air temperature is low, the resistance of the temperature-dependent NTC resistor is high so that the voltage at the junction 11 rises with decreasing temperature. Since the base voltage of the transistor 13 is fixed, the emitter and collector currents of the transistor 13 may be adjusted to any desired value for any particular air temperature and the collector current is added to the charging current $I_A$ from the constant current source 4. The use of an active semiconductor element in the form of a transistor means that the collector current is normally constant. When the air temperature increases, the voltage at the temperature-dependent resistor 8 decreases and the additional current $I_T$ diminishes to the value 0. Hence the injection time $t_m$ is reduced down to a threshold value.

The limiting temperature, above which the transistor 13 blocks, may be adjusted by means of the resistor 17. The magnitude of the effect due to any particular temperature is adjustable by means of the resistor 12.

Figure 2:
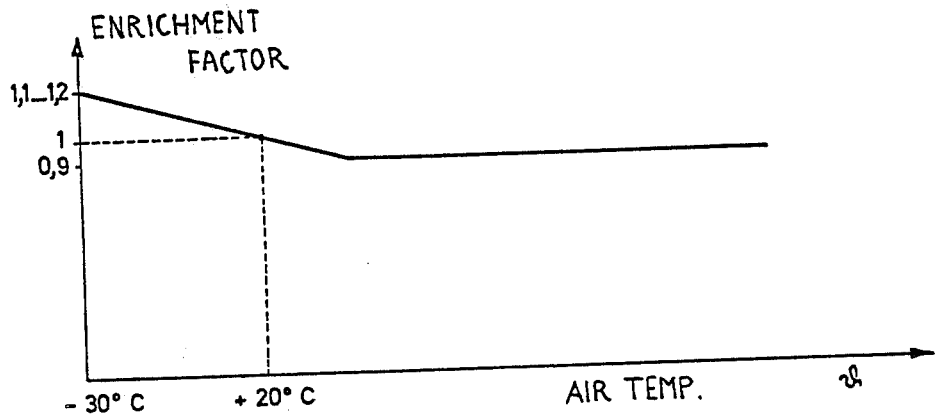
FIG. 2 is a diagram showing the fuel-air enrichment factor as a function of ambient air temperature due to the apparatus according to the invention.

FIG. 2 is a diagram showing the enrichment factor in the fuel-air mixture of the engine as a function of the ambient air temperature due to the effect of the circuit of FIG. 1. It may be seen that when the ambient temperature is −30° C., the fuel-air mixture is enriched by a factor which may be as high as 1.2.

It will be observed that the circuit includes an inverting OR gate 19, one of whose inputs receives the adjusted output pulses $t_m'$ and whose other input receives directly the control pulses $t_p$ and whose output constitutes the control signal for the fuel injection valves.

The foregoing is a decription of a preferred exemplary embodiment of the invention and many variations and further embodiments are possible within the spirit and scope of the claims, the latter being defined by the appended claims.

What is claimed is:

1. In an apparatus for aspirated air temperature dependent fuel control for use with a fuel injection system, said system including an injection signal generator for generating fuel control pulses based on air flow rate and engine rpm, said injection system including a timing capacitor, the improvement comprising:

a first voltage divider circuit defining one of the resistance branches of a bridge circuit, and including series connected resistors connected electrically between the poles of a supply voltage, one of said series connected resistors being a temperature dependent resistor disposed in the induction tube of the engine;

a second voltage divider circuit defining the other of the resistance branches of a bridge circuit, and including series connected resistors connected electrically between the poles of the supply voltage; and an active semiconductor element, whose first terminal electrode is connected to the junction between the resistors of the first voltage divider circuit, which junction is at a potential determined by the air temperature in the induction tube and the temperature dependent resistor, whose second terminal electrode is connected to the injection signal generator, and whose control electrode is connected to the junction between the second voltage divider circuit, whereby said fuel control pulses are changed in accordance with the current delivered by the second terminal electrode of said semiconductor element, and in dependence on air temperature of the air flow in the induction tube of the engine, said current being normally constant with a magnitude which depends solely on the air temperature, and being added to the charging current of the timing capacitor determining the length of said fuel injection pulses.

2. An apparatus as defined by claim 1, wherein said one of the resistors in said second voltage divider circuit is adjustable, thereby permitting adjustment of the potential applied to the control electrode of said semiconductor element.

3. An apparatus as defined by claim 1, wherein said injection signal generator includes a monostable multivibrator, and separate current sources for charging and discharging, respectively, said timing capacitor, and wherein said second terminal electrode of said semiconductor element is connected to the current source which charges said timing capacitor.

4. An apparatus as defined by claim 3, the improvement further comprising OR gate means, one of whose inputs receives control pulses directly from said injection signal generator and the other input receives control pulses modified by the current from said semiconductor element, whereby the output pulses from said OR gate are modified in duration by the time constant of said multivibrator.

5. An apparatus as defined by claim 3, wherein said semiconductor element is a transistor whose collector is connected to the current source which charges said timing capacitor, thereby delivering a temperature dependent additional current and whose emitter is connected via an adjustable resistor to said junction of resistors in said first voltage divider.

* * * * *